US006695166B2

(12) United States Patent
Long

(10) Patent No.: US 6,695,166 B2
(45) Date of Patent: Feb. 24, 2004

(54) VENDING MACHINE INVENTORY SYSTEM AND METHOD

(75) Inventor: Joseph D. Long, Greensboro, NC (US)

(73) Assignee: Vending Management Services, Ltd., Masterton (NZ)

( * ) Notice: Subject to any disclaimer, the term of this patent is extended or adjusted under 35 U.S.C. 154(b) by 140 days.

(21) Appl. No.: 09/964,007

(22) Filed: Sep. 26, 2001

(65) Prior Publication Data

US 2003/0057226 A1 Mar. 27, 2003

(51) Int. Cl.[7] ..... G07F 11/00

(52) U.S. Cl. ..... 221/14; 700/238

(58) Field of Search ..... 700/238; 221/14, 221/6, 123, 129, 125; 194/10, 217

(56) References Cited

U.S. PATENT DOCUMENTS 4,593,361 A * 6/1986 Otten ..... 700/238

* cited by examiner

*Primary Examiner*—Kenneth W. Noland
(74) *Attorney, Agent, or Firm*—Withrow & Terranova PLLC

(57) ABSTRACT

A vending machine containing one or more racks that contain stacked products to be vended to customers. An array of capacitive switches or capacitive switches are aligned on one or more racks. The capacitive switches are each aligned with the height of a product to be vended. A controller coupled to the array of capacitive switches senses the presence or lack thereof of a product in the rack, and correlates this presence or absence to a height and/or inventory count of products in the racks. The vending machine, using the controller and communication electronics, may communicate the height and/or inventory count of products in the racks to a device located outside of the vending machine, such as a hand-held computing device and/or a management system, over a communication link.

40 Claims, 6 Drawing Sheets

VENDING MACHINE INVENTORY SYSTEM AND METHOD

FIELD OF THE INVENTION

The present invention relates to a vending machine that contains an array of capacitive switches to determine the height and/or inventory of products contained in the racks inside the vending machine.

BACKGROUND OF THE INVENTION

Vending machines contain goods, products and/or services that are vended to customers. One type of common vending machine is a beverage vending machine that vends beverages contained in aluminum cans.

Vending machines contain racks that store the products to be vended. The racks are vertical storage areas in which the products are stacked on top of each other. When a product is selected, the rack releases the product contained in the bottom of the rack, and the products stacked onto top of the bottom product move down one position. The products in the rack continue to move down in position until the last product in the rack is vended. Service personnel refill the racks with products periodically to preferably keep the racks from being totally emptied.

Racks in the vending machine contain products of the same type so that a product selection by a customer corresponds to a particular rack that contains the type of product selected. For example, a vending machine that has five beverage selections contains at least five different racks; one for each beverage selection. Some vending machines contain more racks than product selections. If a particular product is vended more often than others, the more popular product may be contained in more than one rack so that the vending machine does not run out of the popular product faster than other products.

Most vending machines are not capable of detecting the actual inventory count of products in its racks. The vending machine may be capable of counting the number of vended products, but there is no guarantee that a service person filled up the rack completely at the last fill up. Some vending machines may also not have knowledge of their maximum capacity so that the number of vended products can be subtracted from the maximum capacity to determine the actual inventory of products remaining in a given rack.

Some vending machines may contain an array of switches that are aligned with products and are capable of detecting the height of products remaining in a given rack. The height of the products can be correlated to the actual number of products in the rack if the products each have uniform height. For example, U.S. Pat. No. 4,398,651 to Kumpfer et al. entitled "Microwave food dispensing machine" discloses a food vending machine that contains an array of magnetic reed switches to detect the height of remaining products. However, magnetic reed switches may not work properly in a vending machine that contains a cooled environment, such as a cold beverage vending machine, due to condensation occurring around the switches. Other types of switches, such as weight sensors, are not practical due to the fact that a weight sensor would have to be placed on a moveable rack release arm.

Therefore, a need exists to provide an array of switches aligned with products in a vending machine rack to detect the height and/or inventory of the products that is not susceptible to condensation caused by a cooled environment and/or does not have to be attached to the moveable rack release arm.

SUMMARY OF THE INVENTION

The present invention relates to a vending machine that contains racks with stacked products for vending to consumers. An array of capacitive switches is aligned with the racks containing the vended products. The array of capacitive switches are coupled to a control system that is capable of determining if a vended product is present at a particular location in the rack. In one embodiment, the array of capacitive switches is comprised of a plurality of capacitive switches.

The control system is capable of determining the height of the products in the rack using the array of capacitive switches. Since the products are typically of a uniform individual height and there are no space gaps between stacked products, the total number of products in a given rack can be derived from the height of highest product contained in the rack.

The control system is adapted to communicate the height and/or inventory of products in the rack to an outside communication device, such as a hand-held device and/or a remote site. The communication link between the control system and the outside communication device may be a wired or wireless connection.

DETAILED DESCRIPTION OF THE INVENTION

Figure 1:
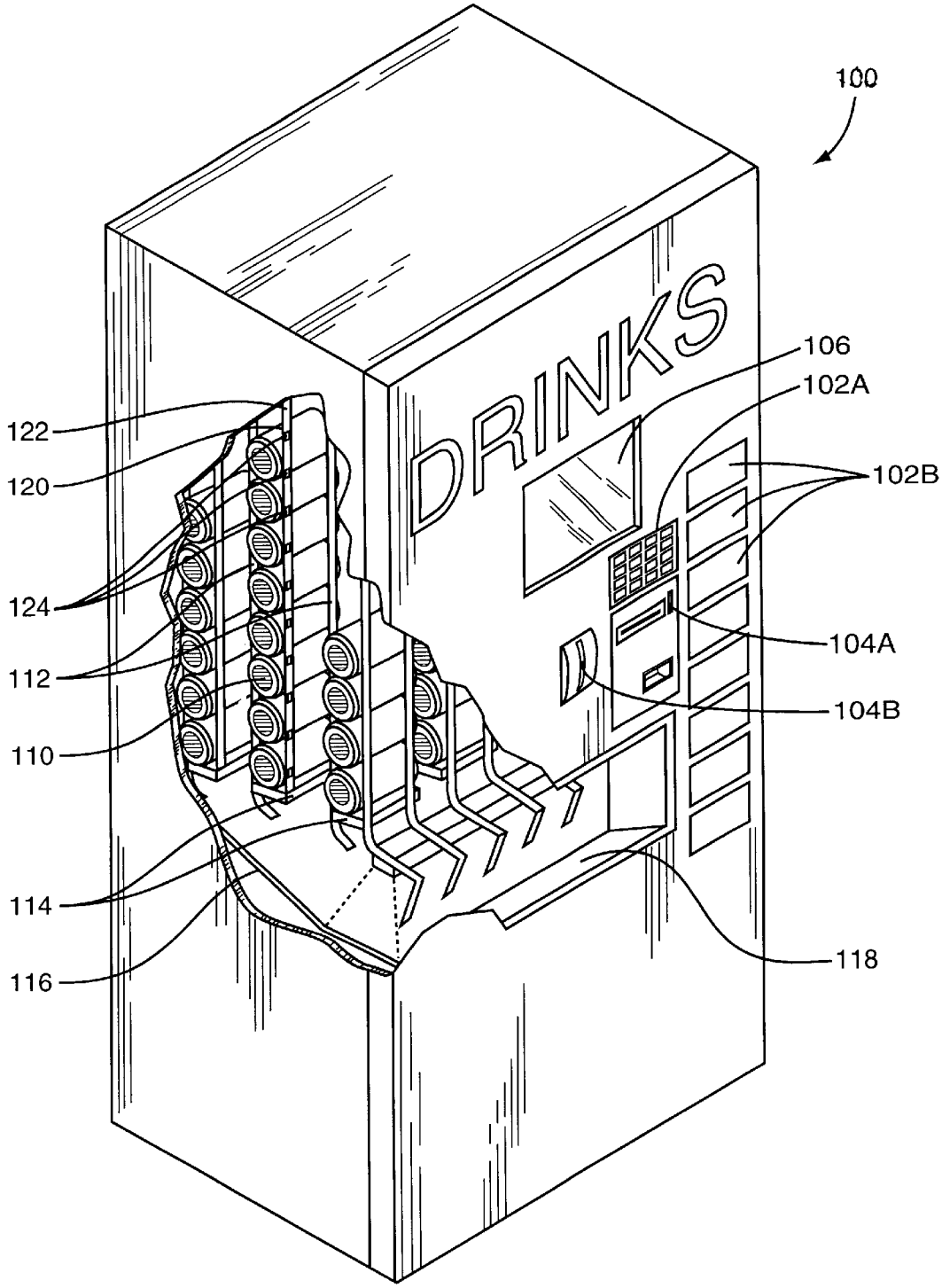
FIG. 1 is a schematic diagram of a vending machine containing an array of capacitive switches aligned with the products in the racks.

FIG. 1 depicts a vending machine 100 according to one exemplary embodiment of the present invention, in the form of a cold beverage vending machine. The vending machine 100 is a self-contained, fully automated product dispensing system. Before discussing the aspects of the present invention, a discussion of a typical vending machine 100 operation is discussed below.

The vending machine 100 requires certain communication with the customer to effect the vending of products. At a minimum, these communications comprise product selection (if more than one product is offered by vending machine 100) and payment for the product. These communications may be accomplished as simply as the well-known product selection buttons and coin acceptor. Additionally, however, they may comprise a wide variety of technologies that enable a rich dialogue between vending machine 100 and the customer. Interface and communications technologies are discussed herein under the broad categories of input, payment, and output.

The vending machine 100 contains a product selector 102 functional to establish consumer communication with the vending machine 100 for the selection of desired product(s). The product selector 102 may comprise a mechanism requiring tactile contact by the consumer, for example a keyboard, keypad, touch screen, or programmable function keys. Alternatively, product selector 102 may be of a form that requires no physical contact, such as a transponder or other wireless communication, a smart card, speech recognition, or a direct link to a secondary device such as a PDA or laptop computer. In one embodiment, as depicted in FIG. 1, the vending machine 100 contains a keypad 102A and product selection buttons 102B to facilitate customer selection from among the variety of beverages available.

The vending machine 100 may also contain one or more payment devices 104 for allowing the customer to pay for his purchases. This may be done directly, for example with a cash acceptor operative to accept and verify currency and coins. Alternatively, the payment device 104 may be effective to identify a credit or cash account number. For example, the payment device 104 may comprise a magnetic stripe card reader, a transponder effective to receive an account number wirelessly, or a smart card reader. An illustrative example of a transponder payment device is disclosed in U.S. Pat. No. 5,347,280, entitled "Frequency diversity transponder arrangement," the disclosure of which is incorporated herein by reference in its entirety. The payment device 104 may alternatively comprise an optical reader effective to detect interpretive visual indicia such as a bar code. An illustrative example of a bar code reader payment device is disclosed in U.S. Pat. No. 5,327,066, entitled "Method and apparatus for dispensing a consumable energy source to a vehicle," the disclosure of which is incorporated herein in its entirety.

Additionally or alternatively, the payment device 104 may be effective to recognize the consumer, either to thereby associate an account number with the consumer or as a security measure to validate an account number otherwise received. This may comprise, for example, a camera and associated facial recognition system. Alternatively, the payment device 104 with customer recognition may include a biometric sensor, for example, a camera effective to detect and interpret eye iris patterns, a fingerprint detector, or the like. In the embodiment depicted in FIG. 1, the vending machine 100 includes a cash acceptor 104A and a magnetic stripe card reader 104B, to facilitate payment for the products vended.

The vending machine 100 may additionally include an output device 106 to facilitate communication with the customer. The output device 106 may present the customer with instructions, various menus or other selections of products available for purchase, and may additionally present entertainment content and/or advertising. The output device 106 may comprise a text or graphic output display that may be of any technology or type known in the art, illustratively including any of a variety of liquid crystal displays (LCD), both Passive Matrix (PMLCD) and Active Matrix (AMLCD)—including Thin-Film Transistor (TFT-LCD), Diode Matrix, Metal-Insulator Metal (MIM), Active-Addressed LCD, Plasma-Addressed Liquid Crystal (PALC), or Ferroelectric Liquid Crystal Display (FLCD). Alternatively, the display may comprise Plasma Display Panel (PDP), Electroluminescent Display (EL), Field Emission Display (FED), Vacuum Fluorescent Displays (VFD), Digital Micromirror Devices (DMD), Light Emitting Diodes (LED), Electrochromic Display, Light Emitting Polymers, video display (cathode ray tube or projection), holographic projection, etc. Output device 106 may additionally comprise input functions, such as a touch screen display, whereby tactile input from the customer on the screen proximate to a displayed indicia is interpreted as a selection of a product, menu step, or action associated with the indicia. The display technologies discussed above are illustrative in nature, and are not intended to be limiting. In the embodiment depicted in FIG. 1, the vending machine 100 contains a visual display output device 106 for outputting menus, instructions, advertising messages, and the like to the customer.

Alternatively or additionally, the output device 106 may be audible. The output device 106 may also provide for the actual delivery of products in electronic form. This may be accomplished through communication to a secondary device, such as a computer in the consumer's automobile, a PDA or laptop computer, a mobile telephone terminal, a musical playback device, or the like. Connection to the secondary device may be through a wired connection, as through a plug provided on the vending machine 100, or over a wireless radio frequency or optical connection.

Product selection, payment, and output functions may be combined in sophisticated communications interfaces. For example, the vending machine 100 may include a telephonic interface, allowing the customer to communicate via a mobile radio communication terminal. As used herein, a mobile radio communication terminal may comprise a cellular radiotelephone; a Personal Communications Service (PCS) terminal that combines a cellular radiotelephone with data processing capabilities; a Personal Digital Assistant (PDA) that may include a radiotelephone; or a conventional laptop computer, a palmtop computer, or other appliance that includes a radiotelephone transceiver. The mobile radio communication terminal may employ a wide variety of communication standards and protocols, which are published by organizations such as the Telecommunications Industry Association/Electronics Industry Association (TIA/EIA) and the European Telecommunication Standards Institute (ETSI).

Another example of a sophisticated communications interface combining input, payment, and output functions is a short-range wireless network such as the BLUETOOTH® interface designed and promulgated by Ericsson, Inc. BLUETOOTH® is a universal radio interface in the 2.45 GHz frequency band that enables portable electronic devices to connect and communicate wirelessly via short-range, ad hoc networks. Persons interested in various details regarding the Bluetooth technology are referred to the article entitled "The Bluetooth Radio System" by Jaap Haartsen, published in the IEEE Personal Communications, February, 2000, the disclosure of which is incorporated herein by reference.

As shown in the cutaway view in FIG. 1, the vending machine 100 contains an inventory of products 110 (in this embodiment, cans containing beverages). The products 110 are arranged in racks 112 within the interior of the vending machine 100, which may be refrigerated. The products 110 are dispensed from a rack 112 by operation of an actuator 114. The product 110 falls by operation of gravity onto a ramp 116, where it proceeds to a dispensing tray 118, and is retrieved by the customer. In one embodiment, the vending machine 110 contains twelve racks 112. The racks 112 are typically constructed out of a sturdy material, such as metal, steel, or plastic.

An array of capacitive switches 120 is attached to one or more racks 112 in the vending machine 100. The array of capacitive switches 120 is comprised of a thin strip 122 made out of plastic, Lexan, Plexigass, or other medium that contains one or more capacitive switches 124. A capacitive switch 124 is a device that creates a change in return voltage based on the presence of an external devices that affects the electric field created by the capacitive switch 124. The strip 122 may also contain an adhesive on its back or one side so that the strip 122 may be attached to the racks 112.

The capacitive switches 124 are placed inside the strip 122 at predetermined heights so that they are aligned with the products 110 as stored in the racks 112. In this manner, a controller (not shown) coupled to the array of capacitive switches 120 can detect a change in capacitance sensed by each of the capacitive switches 124 to detect whether or not a product 110 is present in the rack 112 at the particular location of the capacitive switch 124. The controller may be coupled to the array of capacitive switches 124 through a wired cable harness or other wired connection, or through a wireless connection using radio or optical communication.

The array of capacitive switches 124 acts as a height detector of the products 110 contained in the rack 112 so that the controller can determine if products 110 are present, and if so at what height. If the products 110 are each of a uniform height, the controller can determine the actual inventory count of the products 110 in a rack 112 by dividing the height of the products 110 detected using the array of capacitive switches 120 by the uniform height of an individual product 110.

An example of a capacitive switch that may be used with the present invention is a capacitive switch. Further examples of capacitive switches are disclosed in U.S. Pat. Nos. 6,225,771; 5,923,522; and 5,757,196, all of which are incorporated herein by reference in their entirety. The capacitive switch 124 senses a different capacitance if a product 110 is present adjacent to the capacitive switch 124 versus if a product 110 is not located adjacent to the capacitive switch 124. In one embodiment, the products 110 are aluminum beverage cans. The metallic contact of the beverage cans causing a change in the capacitance to be detected by the capacitive switch 124, that in turn causes the capacitive switch 124 to open or close as a switch, depending on whether or not the capacitive switch 124 is a normally open or normally closed switch.

Capacitive switches 124 are advantageous to use as product 110 sensing devices over contact type sensing devices and switches. For example, a weight sensor could be placed at the actuator 114 for each of the racks 112 to determine the actual weight of the products 110 stored in the rack 112. If the weight is uniform for each product 110, the number of products 110 in the rack 112 could be calculated by dividing the total weight of the products 110 in the rack 112 by the weight of an individual product 110. However, the actuator 114 is a moving part that moves when a product 110 is vended making it difficult to include a weight sensor. Also, products 110 contained in the racks 112 may not be uniform in weight.

Another advantage of using capacitive switches 124 in lieu of other non-contact switch types, such as magnetic switches like that described in the U.S. Pat. No. 4,398,651 referred to in the "Background of the Invention," relates to the condensation that may be generated inside the vending machine 100, especially if the vending machine 100 has a cooled environment. The compressor in a cooled vending machine 110 tends to cause condensation to form on the internal parts of the vending machine 100, including switches contained in the racks 112 to sense the products 110. The capacitive switches 124 are not sensitive to condensation, and the capacitive switches 124 may be easily placed inside the strip 122 so that the condensation does not reach the capacitive switches 124.

Figure 2:
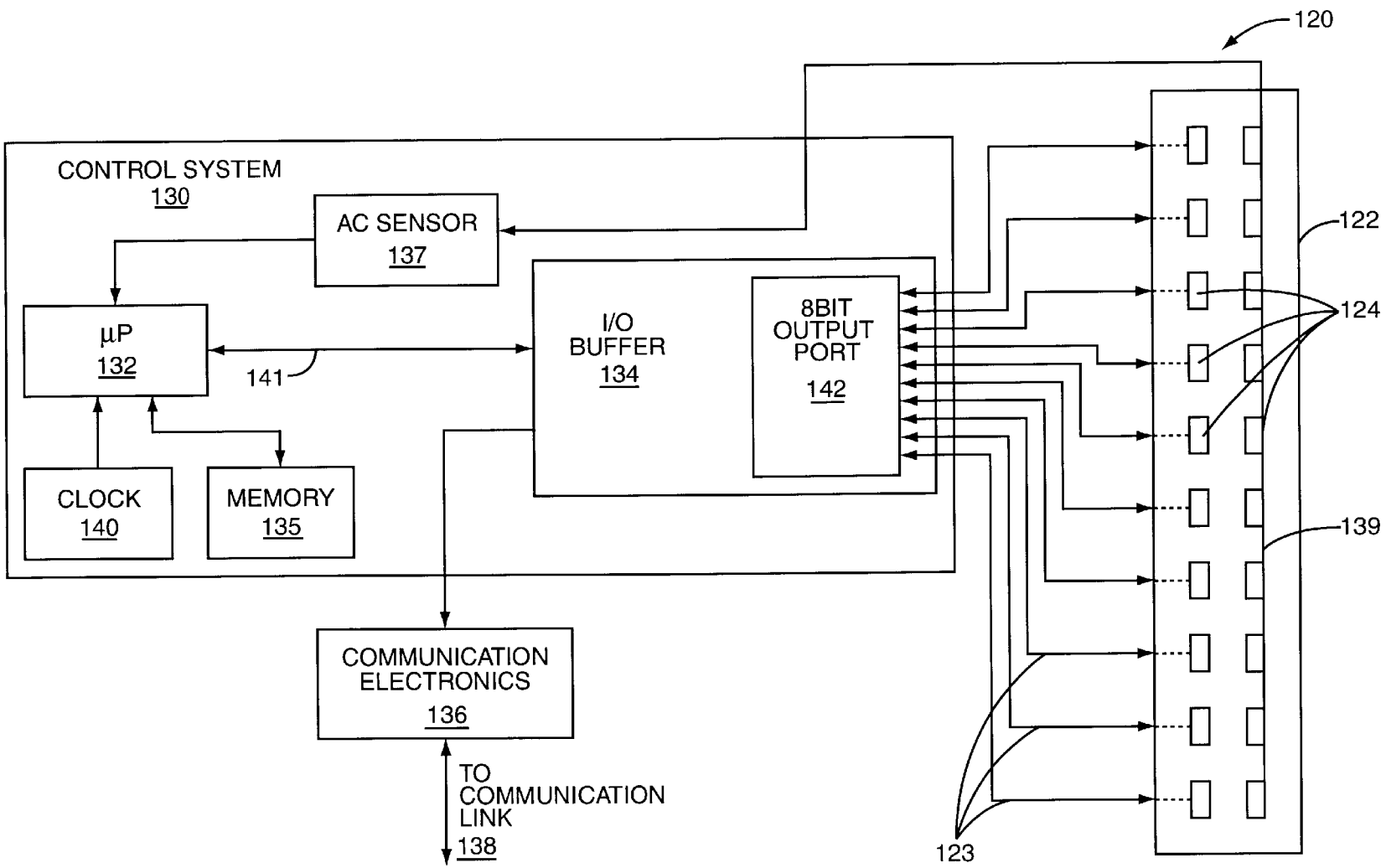
FIG. 2 is a schematic diagram of a control system that drives the array of capacitive switches in a rack to detect the presence of a product.

FIG. 2 illustrates a flowchart diagram of a controller 130 in the vending machine 100 that controls the operation of the vending machine 100 and is adapted to determine the height and/or inventory count of the products 110 contained in the racks 112. The controller 130 is comprised of a microprocessor 132 or other micro-controller. The microprocessor 132 executes software stored in memory 135 to control the hardware elements within the controller 130. The microprocessor 132 is coupled to an input/output buffer 134 for communicating signals between the microprocessor 132 and devices outside of the controller 130. In this embodiment, the input/output buffer 134 contains an 8-bit output port 142 to communicate to scan the strip 122 and capacitive switches 124, discussed below.

The microprocessor 132 is capable of communicating information, including the height and/or inventory count of the products 110, to systems located outside of the vending machine using communication electronics 136. The communication electronics 136 may be a UART, modem, including telephone and cellular, transmitter, including radio-frequency (RF) and optical, or any other type of interface electronics that is capable of sending and receiving communications to and from the controller 130 and outside communication devices. The communications electronics 136 is coupled to a communications link 138 for communications information to and from the vending machine 100.

The output buffer 142 is coupled to the data bus 141 of the microprocessor 132 and to each capacitive switch 124 using scan lines 123. The scan lines 123 are individually addressable by the microprocessor 132. The microprocessor 132, using the output buffer 142, is capable of generating an AC signal to each of the capacitive switches 124, one at a time, to detect the height and/or inventory count of the products 110. The AC signal may be a "1" or "0" generated by the microprocessor at the desired frequency. The optimum frequency would have to be determined depending on the configuration of the capacitive switches 124, but the desirable range is between 10 KHz and 100 KHz so that the microprocessor 132 can directly drive the scan lines 123 with a signal to reduce cost.

The control system 130 also contains an AC sensor 137 that is coupled to each of the capacitive switches 124 to determine if a product 110 is located proximate to a capacitive switch 124. The AC sensor 137 is coupled to the capacitive switches 124 using a return line 139 and is also coupled to the microprocessor 132. The microprocessor 132 uses the voltage signal received from the AC sensor 137 to determine if a product 110 is located in proximity to a particular capacitive switch 124. The strength of the signal on the return line 139 will depend on the proximity and composition of the product 110, but testing of the product 110 during the design can be done to determine the proper threshold return voltage signal strength indicative of the presence of a product 110.

Figure 3:
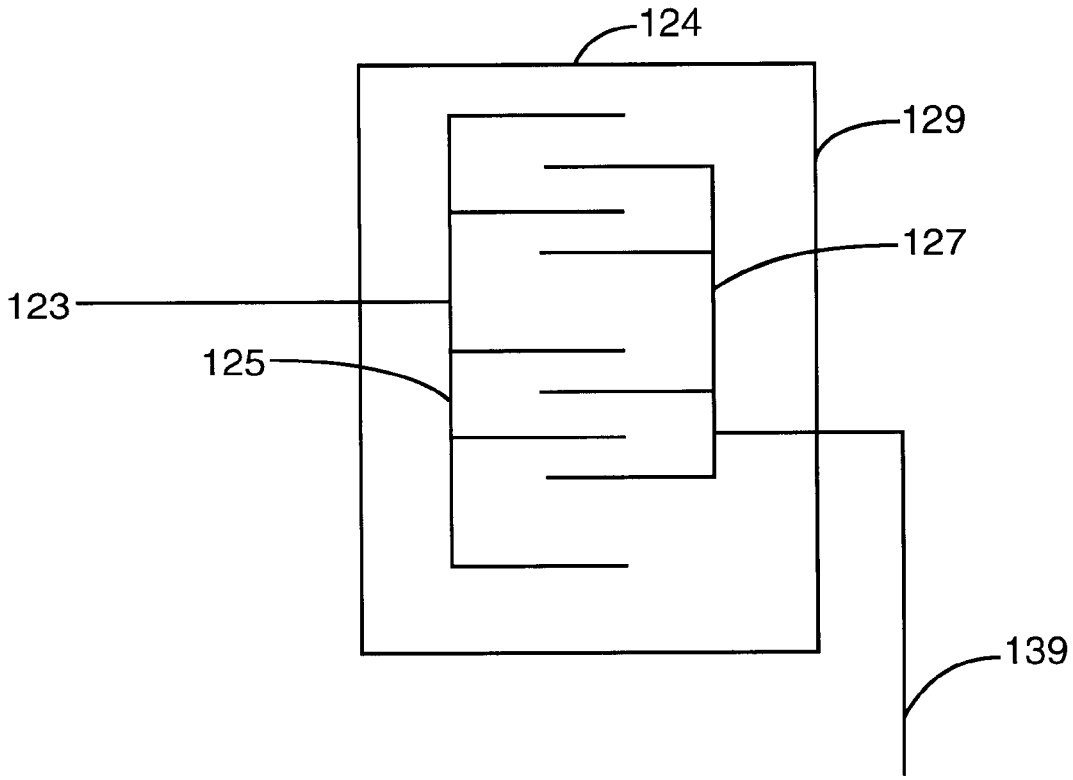
FIG. 3 is a schematic diagram of one embodiment of a capacitive switch.

FIG. 3 illustrates one embodiment of a capacitive switch 124. The capacitive switch 124 is comprised of a conductive scan side 125 and a return side 127. The scan side 125 and the return side 127 are shaped in the form of interlocking "E" shapes. The scan side 125 receives an AC signal from the AC sensor 137. The scan side 125 generates an electric field (not shown) when excited with an AC signal from the AC sensor 137. The return side 127 is energized with a voltage when the electric field generated by the scan side 125 comes into contact with the return side 127. When a product 110 is placed in vicinity to the capacitive switch 124, the electric field generated by the scan side 125 will change in its form and/or characteristics thereby changing the expected voltage on the return side 127. This change in voltage can be used to detect the presence or absence of a product 110. The change in voltage may be an increase or decrease in voltage depending on the type of capacitive switch 124 and product 110. It may also be desired to include a floating metal plate 129 between the E-shaped scan side 125 and return side 127 to make sure that the electric field generated by the scan side 125 is not absorbed by the frame of the vending machine 100.

Figure 4:
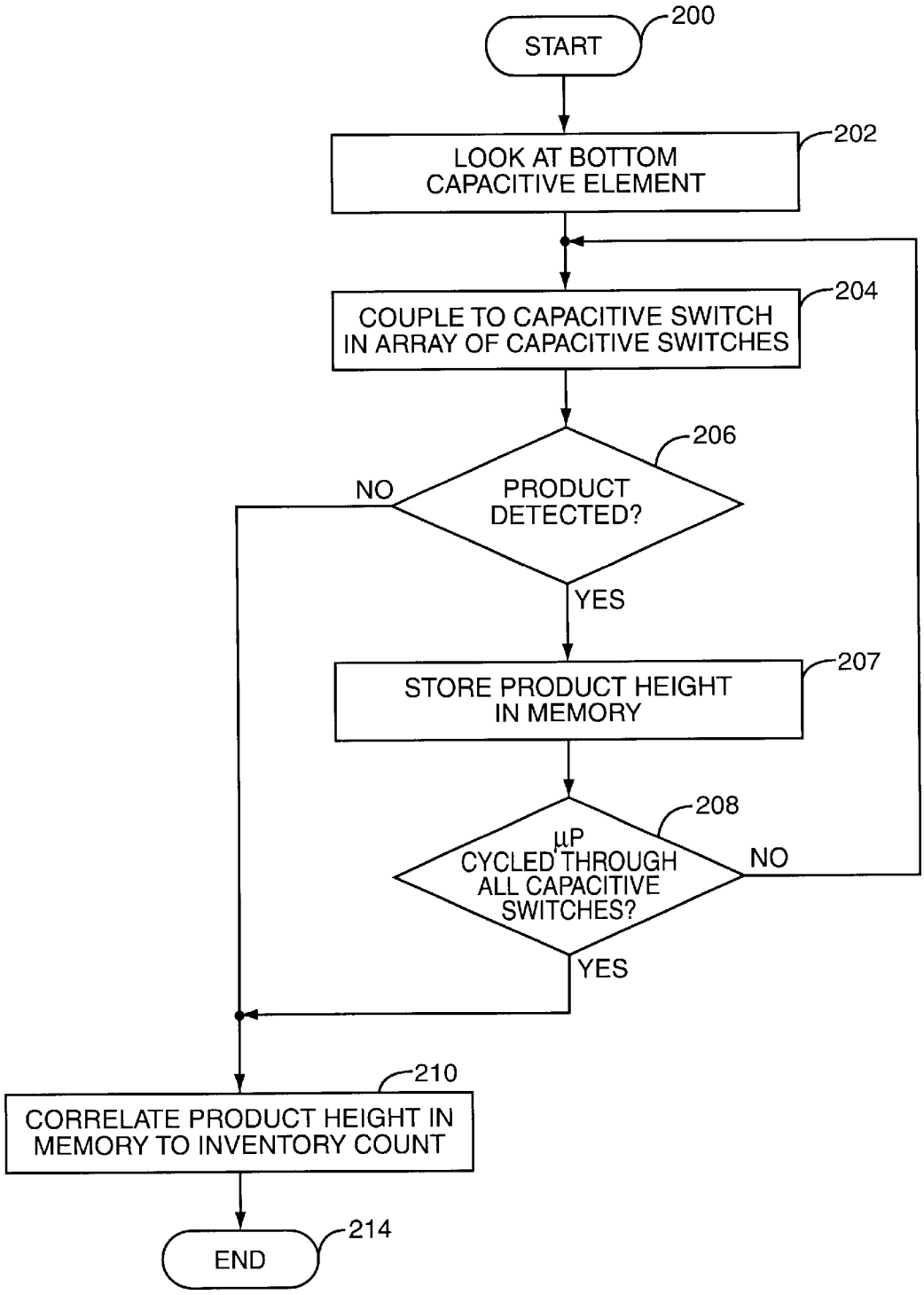
FIG. 4 is a flowchart diagram of the controller determining the height and/or count of products in a rack.

FIG. 4 illustrates a flowchart of this process whereby the microprocessor 132 determines the height and/or inventory count of the products 110 in the racks 112. The process starts (block 200), and the clock 140 is at a state equal to the bottom capacitive switch 124 in the rack 112 (block 202). The microprocessor 132 couples to the capacitive switch 124 in the array of capacitive switches 120 using the output port 142, which is under control of the microprocessor 132 (block 204). The microprocessor 132 determines if a product 110 is detected at the location of the particular capacitive switch 124 coupled to the microprocessor 132 (decision 206).

If a product 110 is not detected, this is indicative of the fact that a product 110 is not physically located at the position of the capacitive switch 124 currently coupled to the microprocessor 132 and that the previously detected product 110 is at the maximum height of the products 110 contained in the rack 112. The microprocessor 132 may additionally correlate the height of the products 110 to an inventory count and store the inventory count in memory 135 (block 210), as discussed above, and the process ends (block 214).

If a product 110 is detected, the microprocessor 132 stores the height of the detected product 110 in memory 135 by correlating the capacitive switch 124 driven that returned the presence of a product 110 (block 207). The microprocessor 132 determines if all of the capacitive switches 124 have been driven with an AC signal (decision 208). If not, the microprocessor 132 couples to the next capacitive switch 124 in the array of capacitive switches 120 (block 204) and the process repeats. If yes (decision 208), the microprocessor 132 may additionally correlate the height of the products 110 to an inventory count and store the inventory count in memory 135 (block 210), as discussed above, and the process ends (block 214).

Figure 5:
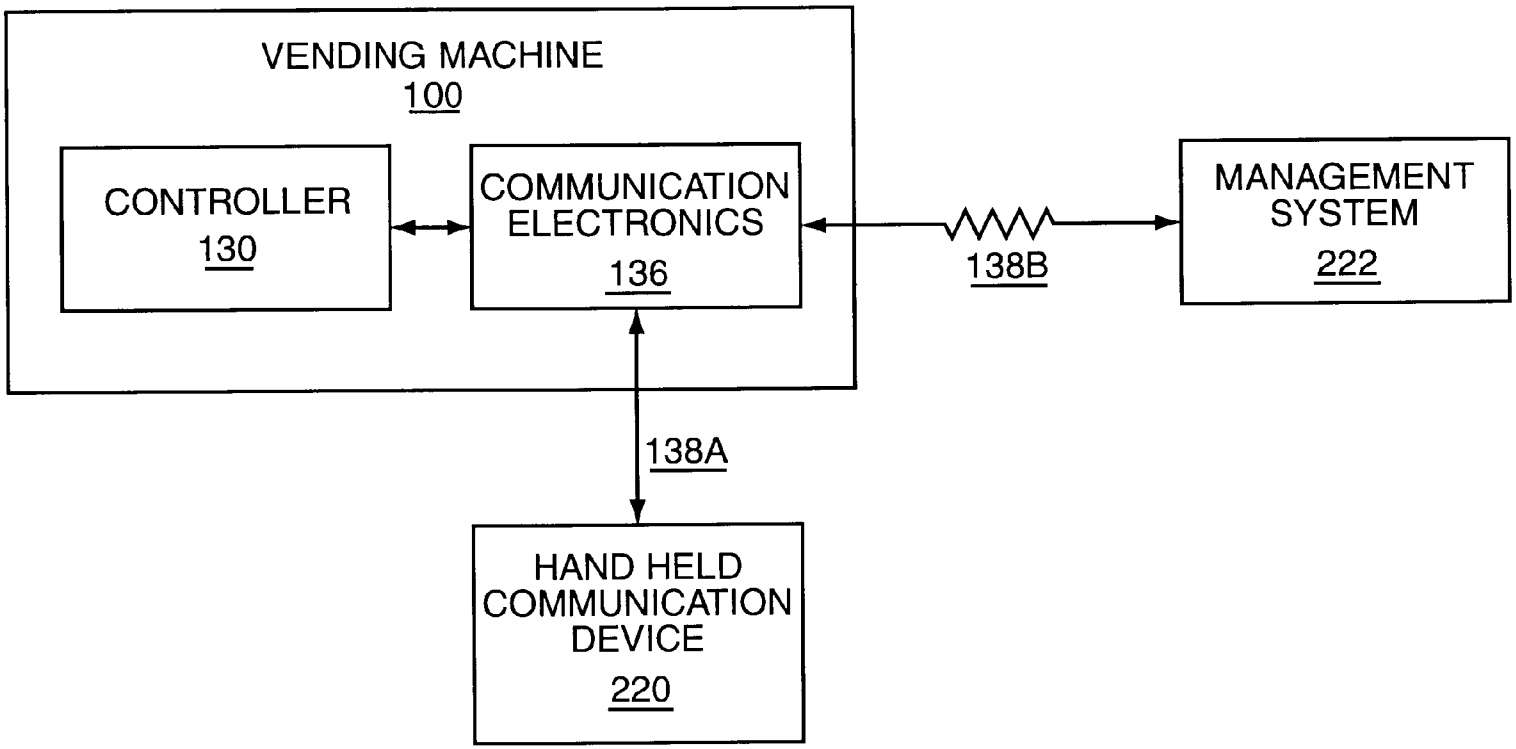
FIG. 5 is a schematic diagram of an inventory communication system for a vending machine.

FIG. 5 illustrates a block diagram of communication between the vending machine 100 and external communication devices. The controller 130 is coupled to the communication electronics 136, as discussed above, to provide an interface for communications to outside devices and/or systems. In this particular embodiment, the communication electronics 136 is adapted to communicate information, including the height and/or inventory count of products 110 in the vending machine 100, to a hand-held communications device 220 via the local communication line 138A coupled to the communication electronics 136. The hand-held communications device 220 may be a computer, a laptop computer, a PDA or other compact computing device.

The communication electronics 136 may also be adapted to provide communications over a more remote communication link 138B to a system located remotely from the vending machine 110, such as to a management system 222. In this manner, the controller 130 may communicate information, including the height and/or inventory count of the products 110 to the management system 222.

Figure 6:
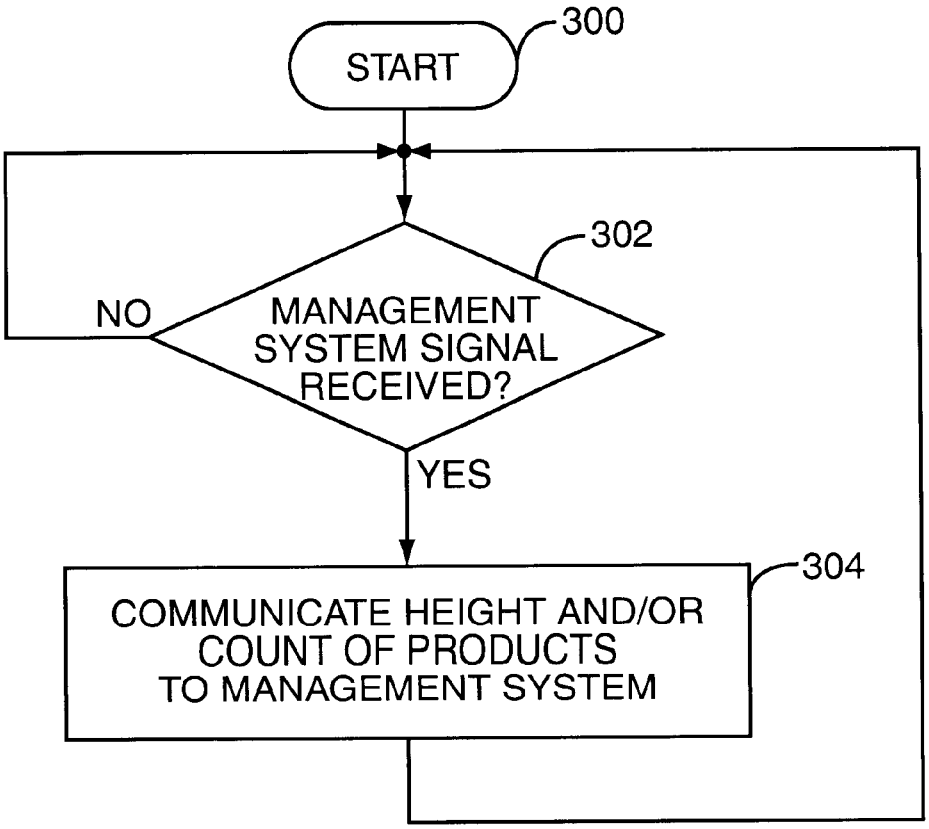
FIG. 6 is a flowchart diagram of one embodiment of a communication session between a management system and a vending machine to ascertain the inventory of products in the vending machine.

The hand-held communication device 220 and/or the management system 222 may initiate communications to the controller 130 over the communication link 138A, 138B to query information, including the height and/or the inventory count of the products 110 in the vending machine 100, like described in U.S. Pat. No. 6,181,981 entitled "Apparatus and method for improved vending machine inventory maintenance," incorporated herein by reference in its entirety. FIG. 6 illustrates a flowchart diagram of this process.

The process starts (block 300), and the controller 130 determines if a query signal has been received from the hand-held communication device 220 and/or the management system 222 for information, including but not limited to the height and/or inventory count of the products 110 in the vending machine 100, as previously described above (decision 302). If the controller 130 does not receive such signal, the process repeats by the controller 130 again determining if such signal has been received (decision 302). The controller 130 may use polling or interrupts to detect the receipt of the signal from the hand-held communication device 220 and/or the management system 222.

If the controller 130 does receive a signal indicating query from a hand-held communication device 220 and/or the management system 222, the vending machine 100 communicates the height and/or inventory count of the products 110 to the hand-held communication device 220 and/or management system 222 (block 304). After the controller 130 communicates the height and/or inventory count of the products 110 contained in the racks 112, the controller 130 waits again for another query signal (decision 302).

Certain modifications and improvements will occur to those skilled in the art upon a reading of the foregoing description. It should be understood that the present invention is not limited to any particular type of component including, but not limited, to the vending machine 100 and its components, the products 110, the racks 112, the array of capacitive switches 120 and the capacitive switches 124, the strip 122, the controller 130, the microprocessor 132, the input/output buffer 134, the memory 135, the communication electronics 136, the AC sensor 137, the communication link 138, the clock 140, the output port 142, the hand-held communication device 220, and the host management system 222. For the purposes of this application, couple, coupled, or coupling is defined as either a direct connection or a reactive coupling. Reactive coupling is defined as either capacitive or inductive coupling.

One of ordinary skill in the art will recognize that there are different manners in which these elements can accomplish the present invention. The present invention is intended to cover what is claimed and any equivalents. The specific embodiments used herein are to aid in the understanding of the present invention, and should not be used to limit the scope of the invention in a manner narrower than the claims and their equivalents.

What is claimed is:

1. A vending machine that vends products, comprising:

a housing;

at least one rack that contains the products to be vended;

a controller that is coupled to said at least one rack to vend the products when a product selector coupled to said controller and associated with said at least one rack is selected; and an array of capacitive switches coupled to said controller and placed in said at least one rack wherein each of said capacitive switches in said array of capacitive switches is aligned each position for said products in said at least one rack;

said controller adapted to determine the height of the products contained in said at least one rack by sensing the capacitance of said positions for the products using said array of capacitive switches.

2. The vending machine of claim 1, wherein said array of capacitive switches is comprised out of a plurality of capacitive switches.

3. The vending machine of claim 1, wherein said array of capacitive switches is contained inside a strip containing an adhesive back that is attached to said at least one rack.

4. The vending machine of claim 3, wherein said strip is comprised from the group consisting of plastic, Lexan, and Plexiglass.

5. The vending machine of claim 1, wherein said array of capacitive switches is coupled to said controller using a cable harness.

6. The vending machine of claim 1, wherein said at least one rack is comprised out of twelve racks.

7. The vending machine of claim 1, wherein said array of capacitive switches is comprised out of twelve capacitive switches.

8. The vending machine of claim 1, wherein said controller further comprising an output port coupled to said array of capacitive switches to drive an AC signal to one capacitive switch in said array of capacitive switches at a time to detect the presence of the products.

9. The vending machine of claim 1, wherein said at least one rack is comprised from the group consisting of out of metal and plastic.

10. The vending machine of claim 1, wherein said controller correlates said height of the products in said at least one rack to an inventory count of the products in said at least one rack.

11. The vending machine of claim 10, wherein said controller communicates said inventory count over a communication link to a management system.

12. The vending machine of claim 11, wherein said controller communicates said inventory count over said communication link to said management system in response to a signal received by said controller from said management system.

13. The vending machine of claim 11, wherein said management system is located remotely from said controller.

14. The vending machine of claim 11, wherein said controller further comprises a transmitter to communicate said inventory count over said communication link.

15. The vending machine of claim 14, wherein said transmitter is comprised from the group consisting of a modem, a cellular phone modem, an optical transmitter, and a radio-frequency transmitter.

16. The vending machine of claim 11, wherein said communication link is comprised from the group consisting of a wired connection, a wireless connection, a telephone line, a data line, a cellular line, and a radio-frequency line.

17. The vending machine of claim 10, wherein said controller communicates said inventory count to a hand-held communication device.

18. The vending machine of claim 1, wherein said controller communicates said height of the products over a communication link to a management system.

19. The vending machine of claim 18, wherein said controller communicates said height of the products over said communication link to said management system in response to a signal received by said controller from said management system.

20. The vending machine of claim 18, wherein said management system is located remotely from said controller.

21. The vending machine of claim 18, wherein said controller further comprises a transmitter to communicate said height of the products over said communication link.

22. The vending machine of claim 21, wherein said transmitter is comprised from the group consisting of a modem, a cellular phone modem, and a radio-frequency transmitter.

23. The vending machine of claim 18, wherein said communication link is comprised from the group consisting of a wired connection, a wireless connection, a telephone line, a data line, a cellular line, and a radio-frequency line.

24. The vending machine of claim 1, wherein said controller communicates said height of the products to a hand-held communication device.

25. The vending machine of claim 1, wherein said capacitive switches comprise an E-shaped scan side that interlocks to an E-shaped return side.

26. The vending machine of claim 25, wherein said capacitive switches further comprise a metal plate to prevent an electric field generated by said capacitive switches from being absorbed by the vending machine.

27. A method of constructing a vending machine that vends products and contains an inventory counter, comprising the steps of:

placing an array of capacitance switches in a rack in the vending machine;

aligning said array of capacitive switches with the products;

coupling said array of capacitive switches to a controller; and placing said array of capacitive switches in a strip.

28. The method of claim 27, further comprising placing an adhesive material on the back of said strip.

29. The method of claim 28, further comprising attaching said strip onto said rack.

30. A method of determining the inventory count of products vended in a vending machine, comprising the steps of:

(a) sensing the capacitance of a first position in a rack;

(b) determining if the product is located at said first position in said rack; and (c) determining the height of the products in said rack by repeating steps (a)–(b) for all other positions in said rack until a product is not detected in said rack.

31. The method of claim 30, wherein said steps (a)–(b) are further performed by switching between each of the capacitive switches in said array of capacitive switches to couple said controller to said each of said capacitive switches one at a time.

32. The method of claim 30, further comprising correlating said height of the products to an inventory count.

33. The method of claim 32, further comprising communicating said inventory count over a communication link to a management system.

34. The method of claim 33, wherein said communicating is performed in response to a signal received from said management system.

35. The method of claim 33, wherein said communicating further comprises communicating said inventory count remotely over said communication link to said management system.

36. The method of claim 32, further comprising communicating said inventory count to a hand-held communication device.

37. The method of claim 30, further comprising communicating said height of the products over a communication link to a management system.

38. The method of claim 37, wherein said communicating further comprises communicating said height of the products remotely over said communication link to said management system.

39. The method of claim 38, wherein said communicating is performed in response to a signal received from said management system.

40. The method of claim 31, further comprising communicating said height of the products to a hand-held communication device.

* * * * *